US011920890B2

(12) United States Patent
Park

(10) Patent No.: US 11,920,890 B2
(45) Date of Patent: Mar. 5, 2024

(54) MECHANICAL TONFA WITH SPRING-LOADED SWIVELING AND LOCKING SYSTEM

(71) Applicant: Ryan Park, Hinsdale, IL (US)

(72) Inventor: Ryan Park, Hinsdale, IL (US)

( * ) Notice: Subject to any disclaimer, the term of this patent is extended or adjusted under 35 U.S.C. 154(b) by 245 days.

(21) Appl. No.: 17/566,379

(22) Filed: Dec. 30, 2021

(65) Prior Publication Data

US 2023/0213307 A1 Jul. 6, 2023

(51) Int. Cl.
*F41B 15/02* (2006.01)

(52) U.S. Cl.
CPC ..... *F41B 15/02* (2013.01)

(58) Field of Classification Search
CPC ..... F41B 15/02
USPC ..... 463/47.6
See application file for complete search history.

(56) References Cited

U.S. PATENT DOCUMENTS 3,636,811 A * 1/1972 Bailey ..... G10G 7/00 984/258
3,962,949 A * 6/1976 Trowbridge ..... A63B 67/086 84/477 B
4,964,636 A * 10/1990 Ashihara ..... F21V 33/0064 463/47.4
5,108,098 A * 4/1992 Ashihara ..... F41B 15/02 463/47.4
5,188,362 A * 2/1993 Ashihara ..... F41B 15/025 463/47.6
5,192,074 A * 3/1993 Ashihara ..... F41B 15/02 463/47.4
5,192,075 A * 3/1993 Ashihara ..... F41B 15/025 463/47.4
5,224,893 A * 7/1993 Routzong ..... A63H 33/28 446/15
8,771,085 B1 * 7/2014 Clyde ..... G06F 1/1696 463/47.4
2005/0187025 A1 * 8/2005 Shaw ..... F41B 15/02 463/47.6

* cited by examiner

*Primary Examiner* — Michael C Grant
(74) *Attorney, Agent, or Firm* — William Park & Associates Ltd.

(57) ABSTRACT

A mechanical tonfa with a spring-loaded swiveling and locking mechanism. The tonfa includes a main bar with a perpendicular handle. The handle includes a button that engages a spring-loaded locking bar within the handle. The portion of the main bar that connects to the handle includes a circular groove that fits over a circular protrusion on the handle. The main bar also includes an aforementioned plurality of notches, enabling the main bar to lock in multiple positions. When the button is pressed, the locking bar is moved such that it is removed from one of the notches, enabling the main bar to swivel relative to the handle. When the button is released, the force of the spring causes the locking bar to return to its original position, causing the main tonfa bar to lock in one of multiple positions depending on the positions of the plurality of notches.

8 Claims, 3 Drawing Sheets

MECHANICAL TONFA WITH SPRING-LOADED SWIVELING AND LOCKING SYSTEM

BACKGROUND

1. Technical Field

Embodiments of the present disclosure relate generally to a mechanical self-defense tool and more particularly to a self-defense tonfa with a spring-loaded swiveling mechanism.

2. Related Art

A conventional tonfa includes a bar with an orthogonal handle, and martial artists use this tool offensively via swinging the tonfa and loosening their grip on the handle such that the tonfa bar spins around to strike a target. The motion of a traditional tonfa is controlled via the user varying the amount of friction exerted by their hand grip on the handle.

When used for a prolonged period, a tonfa can be difficult to control due to sweat building up on the handle, preventing the user from being able to control the motion of the tool with friction alone. Furthermore, a conventional tonfa requires extensive training in order for a user to be able to swing the tonfa properly.

BRIEF DESCRIPTION OF DRAWINGS

Features, aspects, and embodiments are described in conjunction with the attached drawings, in which.

DETAILED DESCRIPTION

Hereinafter, a spring-loaded swiveling tonfa according to an embodiment of the present invention will be described below with reference to the accompanying drawings.

Figure 1:
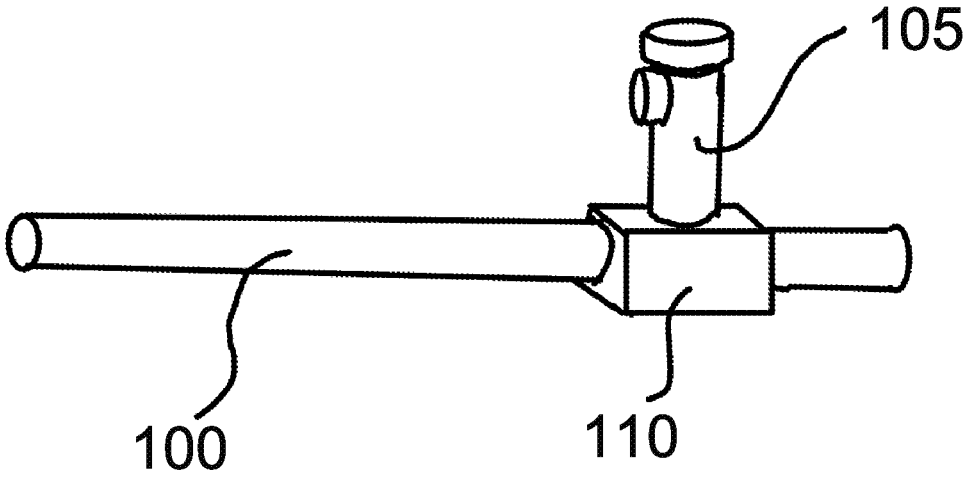
FIG. 1 features an overview of the spring-loaded swiveling tonfa according to an embodiment of the present invention.

Referring to FIG. 1, the spring-loaded swiveling tonfa includes a main bar (100), a handle (105), and a base (110) to which the handle is connected. Alternatively, it is possible for the main bar (100) to be implemented such that it is comprised of multiple pieces that fit together, such as concentric pieces that slide within one another in a telescoping mechanism, or separate pieces that attach to one another via screws or other such fasteners.

Figure 2A:
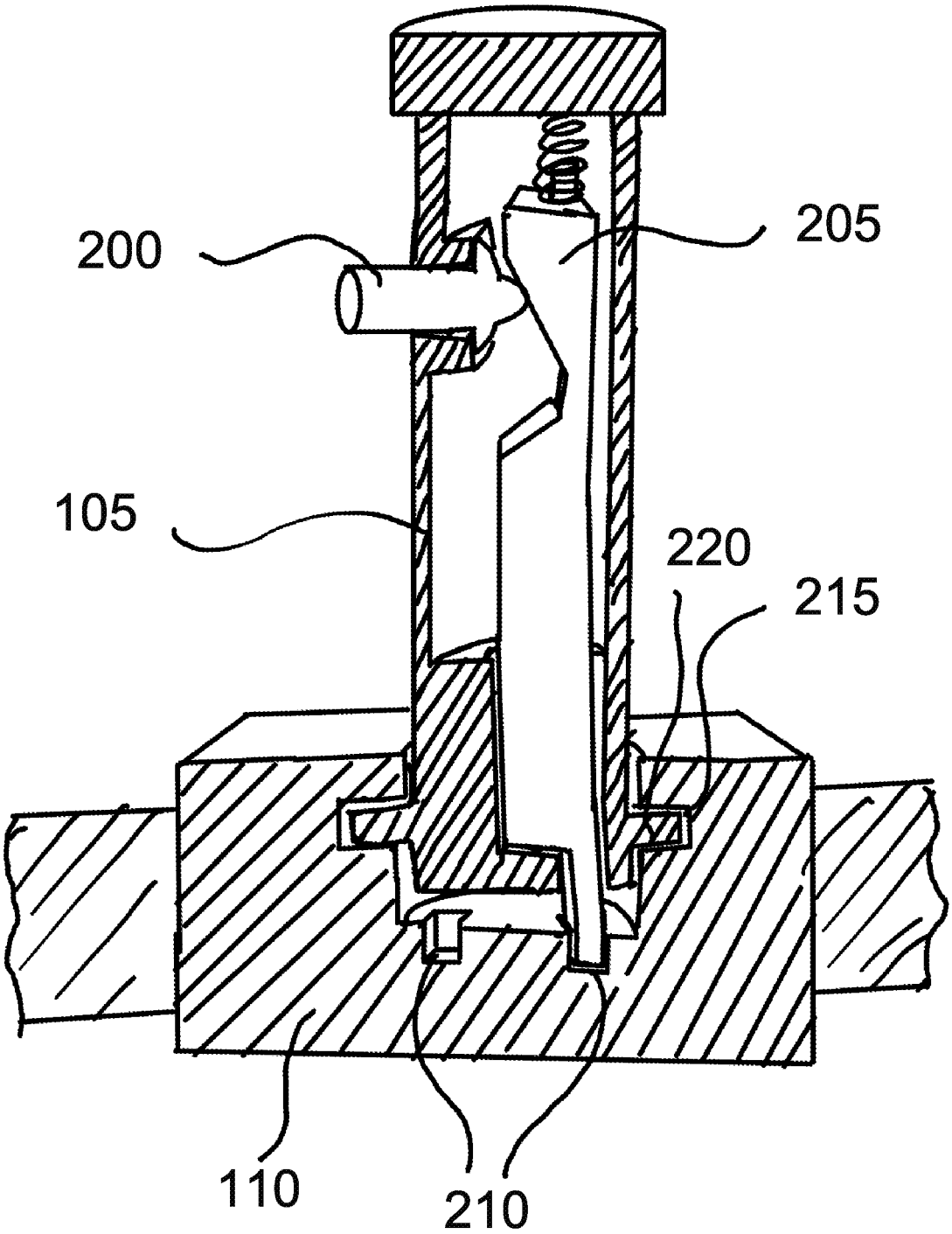
FIG. 2A shows a planar cross-section of the handle of the swiveling tonfa featured in FIG. 1 according to an embodiment of the present invention.

Referring to FIG. 2A, the handle (105) featured in FIG. 1 includes a push button (200) and a locking bar (205) attached to a spring (206). The handle has a protrusion (220) encircling the handle such that the handle locks in securely to a circular groove (215) in the base (110). The base also contains two small notches (210) to which the locking bar (205) connects to.

Figure 2B:
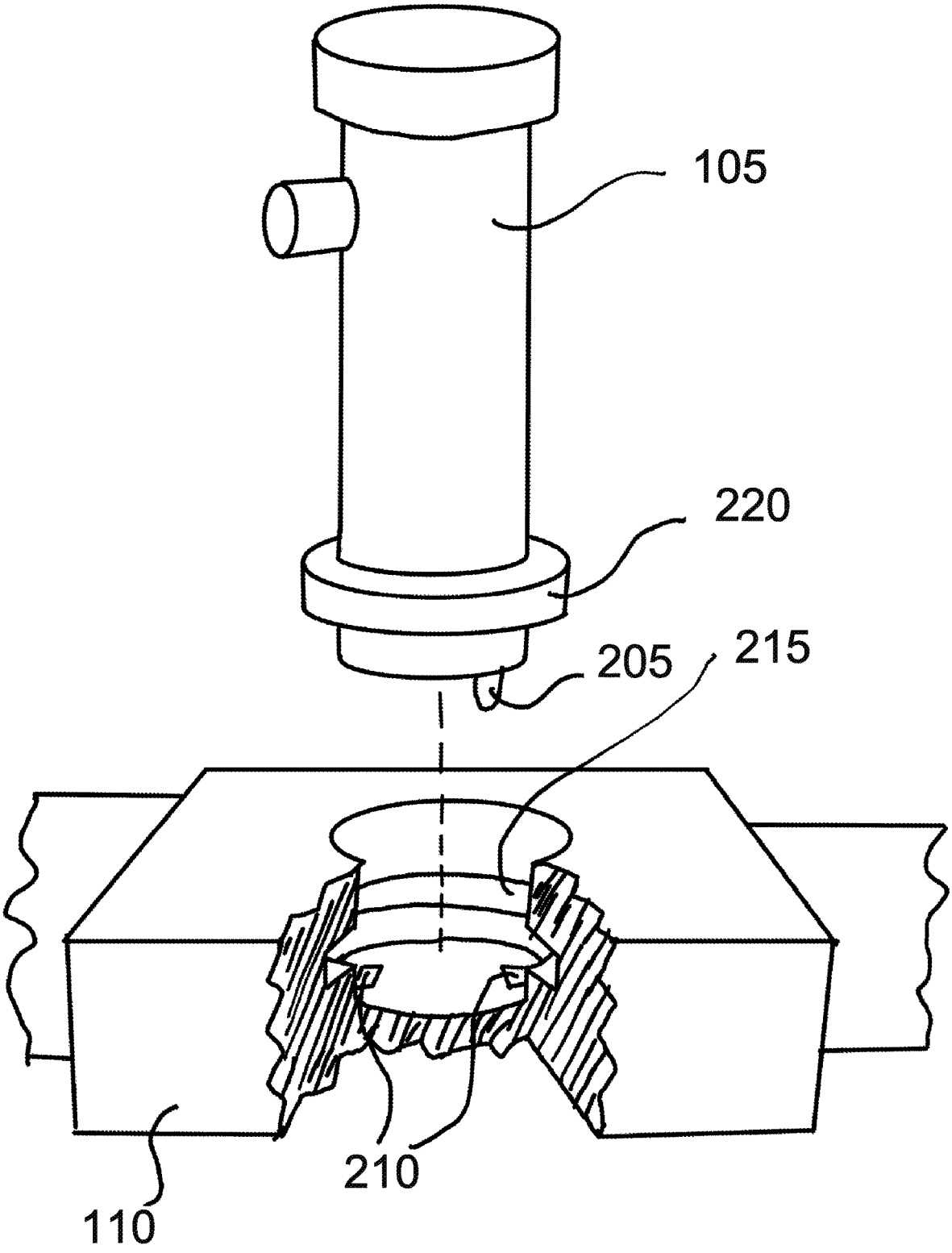
FIG. 2B features a partial cutaway of the tonfa bar featured in FIG. 2A and an exterior view of the handle featured in FIG. 2A.

Referring to FIG. 2B, the circular protrusion (220) circumscribes the portion of the handle that is to be inserted into the tonfa base (110). This circular protrusion is intended to fit into the circular groove (215). The locking bar (205) is long enough such that a portion of the bar sticks out of the bottom of the handle to allow it to fit into the two notches (210).

The locking bar (205) locks the handle and prevents it from swiveling along the circular groove (215) via being inserted into one of the two notches (210). However, when the push button (200) is depressed by a user's finger while holding the handle (105), the locking bar (205) is shaped such that the push button (200) will cause the locking bar to rise against the spring (206). This causes the lower portion of the locking bar to be lifted out of the notches (210), enabling the handle to freely rotate along the circular groove (215). The presence of two notches allows the main bar (100) to freely swing and lock in one of two positions relative to the handle, allowing the user to swing the main tonfa bar without relying on the friction of their hand grip.

Alternatively, the circular groove (215) could contain ball bearings to minimize friction between the circular protrusion (220) of the handle and the circular groove (215) of the main bar.

Alternatively, the action of pressing the button could be reversed, via changing the shape of the angled portion of the locking bar and replacing the spring (206) location, such that pressing the button causes the locking bar to lock into a notch, restricting the motion of the main bar, and releasing the button causes the locking bar to exit a notch, allowing the main bar to swivel freely relative to the handle.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While certain embodiments have been described above, it will be understood to those skilled in the art that the embodiments described are by way of example only. Accordingly, the spring-loaded swiveling tonfa described herein should not be limited based on the described embodiments. Rather, the spring-loaded swiveling tonfa described herein should only be limited in light of the claims that follow when taken in conjunction with the above description and accompanying drawings.

What is claimed is:

1. A spring-loaded swiveling tonfa comprising:

a main bar having a cavity, wherein the sides of the cavity are formed with a circular groove, and wherein a bottom surface of the cavity is formed with one or more notches;

a handle elongated between a top end and a bottom end, wherein the bottom end of the handle is fitted in the circular groove of the main bar so as to allow swiveling motion of the main bar about the elongated axis of the handle, wherein the handle comprises:

a handle bar;

a locking bar inside the handle bar configured to move between the top and bottom ends of the handle, wherein the locking bar comprises:

an angled portion on a predetermined side portion of the locking bar; and a locking end protruding at one end of the locking bar;

a spring inside the handle bar configured to apply pressure on the locking end towards the bottom surface of the circular hole having the one or more notches;

a push button having one end making contact with the angled portion of the locking bar and the other end sticking out of a hole of the handle bar so as to accommodate depression by hand;

a circular protrusion radially extending out at near the bottom end of the handle bar, wherein the circular protrusion is fitted inside the circular groove of the main bar; and wherein, when the push button is not depressed, the locking end is secured in one notch due to the pressure from the spring so as to prevent swiveling motion of the main bar around the handle, and wherein, when the push button is depressed, depression of the push button causes the locking bar to move against the spring to reduce the pressure of the spring so as to disengage the locking end out of the notch and to enable the main bar to freely rotate relative to the handle for as long as the button remains pressed.

2. The spring-loaded tonfa according to claim 1, wherein the main bar further comprises:

a plurality of concentric cylindrical pieces, wherein the pieces can be compacted via a telescoping mechanism where the concentric pieces slide within each other.

3. The spring-loaded tonfa according to claim 1, wherein the main bar further comprises:

a plurality of cylinders in series, wherein the cylinders are fastened to form the elongated main bar via fasteners including a screw.

4. The spring-loaded tonfa according to claim 1, wherein the circular protrusion comprises a ball bearing.

5. A spring-loaded swiveling tonfa comprising:

a main bar having a cavity, wherein the sides of the cavity are formed with a circular groove, and wherein a bottom surface of the cavity is formed with one or more notches;

a handle elongated between a top end and a bottom end, wherein the bottom end of the handle is fitted in the circular groove of the main bar so as to allow swiveling motion of the main bar about the elongated axis of the handle, wherein the handle comprises:

a handle bar;

a locking bar inside the handle bar configured to move between the top and bottom ends of the handle, wherein the locking bar comprises:

an angled portion on a predetermined side portion of the locking bar; and a locking end protruding at one end of the locking bar;

a spring inside the handle bar configured to apply pressure on the locking end towards the bottom surface of the circular hole having the one or more notches;

a push button having one end making contact with the angled portion of the locking bar and the other end sticking out of a hole of the handle bar so as to accommodate depression by hand;

a circular protrusion radially extending out at near the bottom end of the handle bar, wherein the circular protrusion is fitted inside the circular groove of the main bar; and wherein, when the push button is depressed, the locking end is secured in one notch due to the pressure from the spring so as to prevent swiveling motion of the main bar around the handle, and wherein, when the push button is not depressed, depression of the push button causes the locking bar to move against the spring to reduce the pressure of the spring so as to disengage the locking end out of the notch and to enable the main bar to freely rotate relative to the handle for as long as the button remains pressed.

6. The spring-loaded tonfa according to claim 5, wherein the main bar further comprises:

a plurality of concentric cylindrical pieces, wherein the pieces can be compacted via a telescoping mechanism where the concentric pieces slide within each other.

7. The spring-loaded tonfa according to claim 5, wherein the main bar further comprises:

a plurality of cylinders in series, wherein the cylinders are fastened to form the elongated main bar via fasteners including a screw.

8. The spring-loaded tonfa according to claim 5, wherein the circular protrusion comprises a ball bearing.

* * * * *